US007696680B2

(12) United States Patent
Wei et al.

(10) Patent No.: US 7,696,680 B2
(45) Date of Patent: Apr. 13, 2010

(54) FIELD EMISSION DEVICE FOR HIGH RESOLUTION DISPLAY

(75) Inventors: Yang Wei, Bei-Jing (CN); Liang Liu, Bei-Jing (CN); Shou-Shan Fan, Bei-Jing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 557 days.

(21) Appl. No.: 11/307,780

(22) Filed: Feb. 22, 2006

(65) Prior Publication Data

US 2006/0192476 A1 Aug. 31, 2006

(30) Foreign Application Priority Data

Feb. 25, 2005 (CN) ..... 2005 1 0033335

(51) Int. Cl.
*H01J 1/62* (2006.01)

(52) U.S. Cl. ..... 313/495

(58) Field of Classification Search ..... 313/495–497, 313/309

See application file for complete search history.

(56) References Cited

U.S. PATENT DOCUMENTS 5,578,901 A * 11/1996 Blanchet-Fincher et al. 313/496
5,764,004 A * 6/1998 Rabinowitz ..... 315/169.1
5,872,422 A * 2/1999 Xu et al. ..... 313/311
6,437,503 B1 8/2002 Konuma
6,445,124 B1 9/2002 Asai et al.
6,486,609 B1 11/2002 Shiratori et al.
6,545,396 B1 * 4/2003 Ohki et al. ..... 313/309
6,632,114 B2 * 10/2003 Choi et al. ..... 445/24
6,690,116 B2 2/2004 Song et al.
2004/0104667 A1 6/2004 Russ et al.

FOREIGN PATENT DOCUMENTS

JP 2001-189142 A 7/2001
JP 2001-256884 A 9/2001
JP 2003-217484 A 7/2003

* cited by examiner

*Primary Examiner*—Toan Ton
*Assistant Examiner*—Hana A Sanei
(74) *Attorney, Agent, or Firm*—Clifford O. Chi

(57) ABSTRACT

A field emission device (10), in accordance with a preferred embodiment, includes an anode electrode (22), a cathode electrode (12), a gate electrode (16), a phosphor layer (23), and a number of electron emitters (13) formed on the cathode electrode. The anode electrode is opposite to and spaced from the cathode electrode. The phosphor layer is attached/formed on the anode electrode. The gate electrode (preferably in the form of a wire) is spatially positioned between the anode electrode and the cathode electrode. In addition, the gate electrode is correspondingly arranged relative to the phosphor layer. The electron emitters are distributed on surfaces of the cathode electrode at least adjacent to two sides of the gate electrode, thus promoting the ability of the emitted electrons to be guided by, yet not readily impinge on, the gate electrode on a path toward the phosphor layer.

23 Claims, 7 Drawing Sheets

FIELD EMISSION DEVICE FOR HIGH RESOLUTION DISPLAY

CROSS-REFERENCES TO RELATED APPLICATION

This application is related to U.S. patent application entitled "Triode Type Field Emission Display With High Resolution", filed on Mar. 29, 2005, currently co-pending herewith, the content of which is hereby incorporated by reference thereto.

FIELD OF THE INVENTION

The present invention relates to a field emission device and, more particularly, to a high-resolution field emission display having a three-electrode structure of a cathode, an anode and a gate electrode.

DESCRIPTION OF RELATED ART

Field emission displays (FEDs) are new, rapidly developing flat panel display technologies. Compared to conventional technologies, e.g., cathode-ray tube (CRT) and liquid crystal display (LCD) technologies, FEDs are superior in having a wider viewing angle, low energy consumption, a smaller size, and a higher quality display. In particular, carbon nanotube-based FEDs (CNTFEDs) have attracted much attention in recent years.

Carbon nanotube-based FEDs employ carbon nanotubes (CNTs) as electron emitters. Carbon nanotubes are very small tube-shaped structures essentially composed of a graphite material. Carbon nanotubes produced by arc discharge between graphite rods were first discovered and reported in an article by Sumio Iijima, entitled "Helical Microtubules of Graphitic Carbon" (Nature, Vol. 354, Nov. 7, 1991, pp. 56-58). Carbon nanotubes can have an extremely high electrical conductivity, very small diameters (much less than 100 nanometers), large aspect ratios (i.e. length/diameter ratios) (potentially greater than 1000), and a tip-surface area near the theoretical limit (the smaller the tip-surface area, the more concentrated the electric field, and the greater the field enhancement factor). Thus, carbon nanotubes can transmit an extremely high electrical current and have a very low turn-on electric field (approximately 2 volts/micron) for emitting electrons. In summary, carbon nanotubes are one of the most favorable candidates for electrons emitters in electron emission devices and can play an important role in field emission display applications.

Generally, FEDs can be roughly classified into diode type structures and triode type structures. Diode type structures have only two electrodes, a cathode electrode and an anode electrode. Diode type structures are unsuitable for applications requiring high resolution displays, because the diode type structures require high voltages, produce relatively non-uniform electron emissions, and require relatively costly driving circuits. Triode type structures were developed from diode type structures by adding a gate electrode for controlling electron emission. Triode type structures can emit electrons at relatively lower voltages.

FIG. 6 is a cross sectional view illustrating one picture element in a conventional triode type FED. Here, a picture element means a minimum unit of an image displayed by the FED (i.e., a pixel). In a typical color FED, the color picture is obtained by a display system using three optical primary colors, i.e., R (red), G (green), and B (blue). Each one of the colors, e.g., R (red), is included in a respective single picture element. As an example of a conventional FED, a structure is explained below, in which electrons are emitted to excite a red fluorescent picture element to emit light.

As shown in FIG. 6, an insulation film 102 (e.g., an $SiO_2$ film 1 micron thick) is deposited on a substrate 101 by sputtering, a gate electrode 103 (e.g., an aluminum film 200 nanometers thick) is deposited on the insulation film 102, and a tubular gate hole 104 is formed, penetrating the gate electrode 103 and insulation film 102. An emitter 105, formed of a cathode material (e.g., carbon, molybdenum, niobium, or another emissive material), is deposited on the substrate 101 at a bottom of the gate hole 104. An anode electrode 106 is disposed about 5 millimeters above the substrate 101, thus creating a gap between the emitter(s) 105 and the anode electrode 106. A fluorescent layer 107 with a red fluorescent property is coated on part of the anode electrode 106 located just over the gate hole 104. In use, different voltages are applied to the emitter 105, the anode electrode 106 and the gate electrode 103. For example, about 5.1 kilovolts is applied to the anode electrode 106 and the fluorescent layer 107, about 7.0 volts is applied to the emitter 105, and about 100 volts is applied to the gate electrode 103. Thereby, equipotential surfaces (not labeled) are formed. Here, a distance between the anode electrode 106 and the gate electrode 103 is about 5 millimeters, and the voltage is about 5000 volts. Thus, an electric field between the both electrodes 106 and 103 is given by: 5000/5[V/mm]=1 kV/mm On the other hand, a distance between the gate electrode 103 and the emitter 105 is 1 micron (10-3 millimeters), and the voltage is 100 volts. So, an electric field between the gate electrode 103 and the emitter 105 is given by: 100/10−3[V/mm]=100 kV/mm Under this configuration, electrons can be extracted from the emitter 105 by the strong electric field of 100 kV/mm. The electrons are then accelerated toward the anode electrode 106 by the normal electric field of 1 kV/mm. However, electrons such as the electrons 110 and 111 diverge in directions away from a central axis of the picture element while they travel toward the anode electrode 106. As a result only a portion of the emitted electrons, such as the electrons 109, correctly reach the fluorescent layer 107 of the target picture element. In FED, the picture elements are generally arranged very closely together. Therefore, the divergent elections are liable to reach the fluorescent layer 107 of a neighboring picture element. Generally, the fluorescent layer 107 of the neighboring picture element is either green or blue, such that a different color is generated. Also, if electrons arrive at fluorescent layer 107 of a neighboring red-color's picture element, then a failure in space resolution occurs.

U.S. Pat. No. 6,445,124, granted to Hironori Asai et al. and herein incorporated by reference thereto, discloses a field emission device structured to resolve the above-described problems. Referring to FIG. 7, the field emission device includes a cathode layer 203 made of a conductive thin film with a thickness of about 0.01 to 0.9 microns. This cathode layer 203 is formed by deposition or sputtering on an insulation substrate 211. An insulation layer 202 made of $SiO_2$ is formed on the cathode layer 203. A gate electrode 201 is formed on the insulation layer 202. A circular hole (not labeled), having a diameter of 40 to 100 nanometers and penetrating the gate electrode 201 and the insulation layer 202, is formed by a reactive ion etching (RIE) process. An electron emissive layer 207 is formed on the cathode layer 203 inside the hole. A ratio of L/S should be equal to or over 1, where S represents an aperture diameter of the hole, and L represents a typical shortest passing distance of electrons emitted from the emissive layer 207 to the gate electrode 201. When the ratio of L/S is equal to or over 1, paths of electrons emitted from the emissive layer 207 are controlled to become narrow. Only electrons that move in a direction approximately vertical to the electron emissive layer 207 can pass through the hole and reach the anode, such that the electrons reach the correct phosphor unit.

However, the efficiency of electron emission is low, because a portion of electrons emitted from the emissive layer 207 are absorbed by the gate electrode 201 or blocked by the insulation layer 202 when they travel in the hole in directions other than the direction perpendicular to the cathode layer 203. The greater the L/S, the more electrons are lost, and the lower the efficiency of electron emission. In addition, a high L/S ratio means a higher voltage needs to be applied to the gate electrode, in order to generate an electric field strong enough to extract electrons from the emissive layer 207.

Therefore, what is needed is a field emission device having a high resolution, lower voltage for emitting electrons, and a high efficiency.

SUMMARY OF INVENTION

Accordingly, a field emission device, in accordance with a preferred embodiment, includes an anode electrode, a cathode electrode, a gate electrode, a phosphor layer, and a number of electron emitters formed on the cathode electrode. The anode electrode is opposite to the cathode electrode. The phosphor layer is attached on the anode electrode. The gate electrode is arranged between the anode electrode and the cathode electrode. In addition, the gate electrode is juxtaposed to the phosphor layer. The electron emitters are distributed on surfaces of the cathode electrode adjacent to two sides of the gate electrode. That the electron emitters are distributed on surfaces of the cathode electrode at least adjacent to two sides of the gate electrode promotes the ability of the emitted electrons to be guided by, yet not readily impinge on, the gate electrode on a path toward the phosphor layer.

Other objects, advantages and novel features of the present invention will become more apparent from the following detailed description when taken in conjunction with the accompanying drawings.

BRIEF DESCRIPTION OF DRAWINGS

Many aspects of the present field emission device can be better understood with reference to the following drawings. The components in the drawings are not necessarily to scale, the emphasis instead being placed upon clearly illustrating the principles of the present device. Moreover, in the drawings, like reference numerals designate corresponding parts throughout the several views.

The exemplifications set out herein illustrate at least one preferred embodiment of the present field emission device, in one form, and such exemplifications are not to be construed as limiting the scope of the invention in any manner.

DETAILED DESCRIPTION

Reference will now be made to the drawings to describe preferred embodiments of the present field emission device, in detail.

Figure 1:
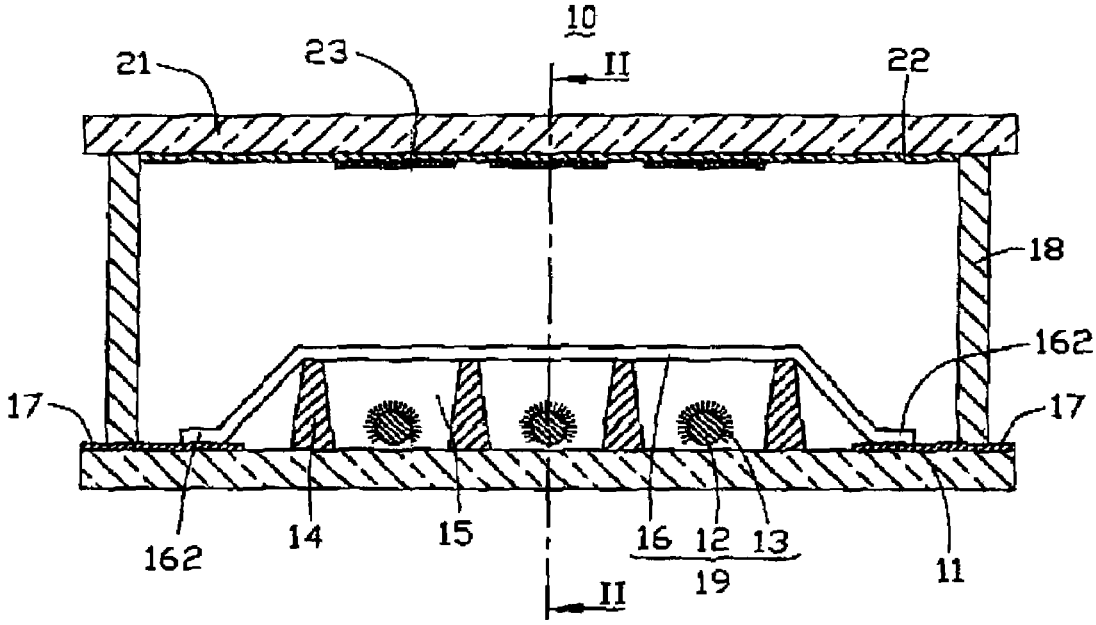
FIG. 1 is a schematic, cross-sectional view of a field emission device, according to a first preferred embodiment.
Figure 2:
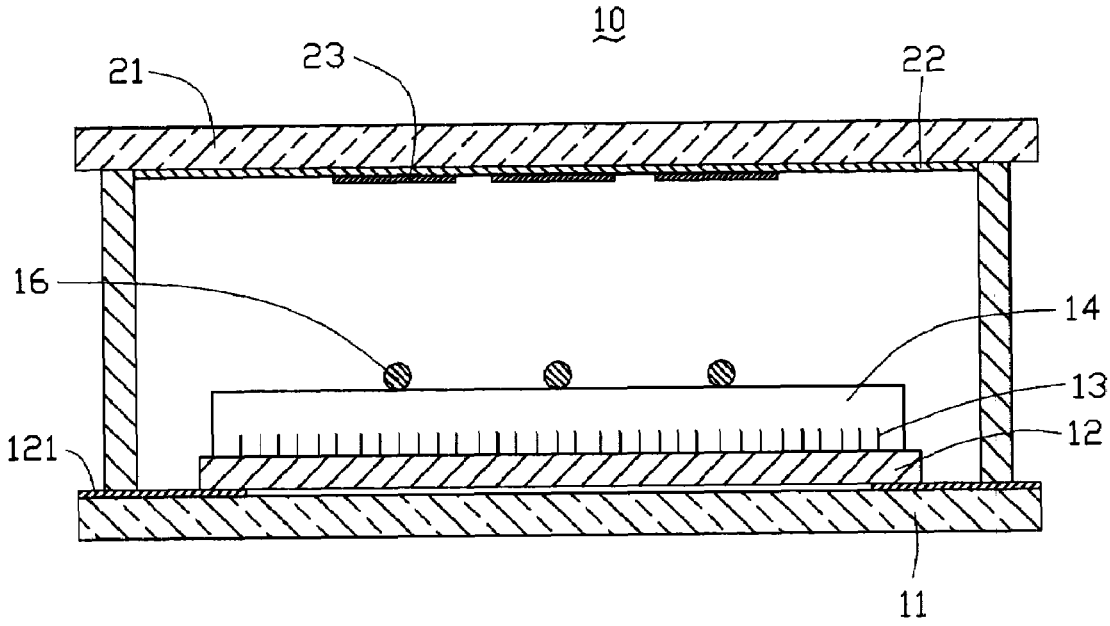
FIG. 2 is a schematic, cross-sectional view taken along line II-II of FIG. 1.

Referring to FIGS. 1 and 2, an exemplarily field emission device 10 in accordance with a first preferred embodiment is shown. The field emission device 10 includes a bottom substrate 11 and a transparent top plate 21, positioned parallel to the bottom substrate 11. A number of insulative spacers 18 are arranged between the bottom substrate 11 and the top plate 21, thereby defining an inner space therebetween. A number of insulative barriers 14 are formed on the bottom substrate 11. The insulative barriers 14 are substantially parallel to each other and are spaced apart from each other a predetermined distance. As such, a slot 15 is defined between each two neighboring insulative barriers 14. The insulative barriers 14 can be wedge-shaped, for example.

A number of cathode wires 12, functioning as cathode electrodes, are provided proximate, i.e., near or directly on, the bottom substrate 11. In the exemplary embodiment, each of the cathode wires 12 is located at a bottom of a respective slot 15 and is substantially parallel to the insulative barriers 14. Advantageously, the field emission device 10 further includes a number of cathode pads 121 positioned on two opposite lateral sides of the bottom substrate 11, such cathode pads 121 being configured (i.e., structured and arranged) for holding the cathode wires 12. Two opposite ends of each cathode wire 12 are attached to and electrically connected with two corresponding cathode pads 121. Each of the cathode pads 121 has a portion extending outside of the inner space defined by the bottom substrate 11, the top plate 21 and the insulative spacers 18. Each such extending portion is configured for facilitating connection with a first signal transferring device (not shown). A number of electron emitters 13 are formed on a surface of the cathode wires 12 for emitting electrons. The electron emitters 13 can be, for example, nanotubes formed of, e.g., carbon or another emissive material.

A number of gate wires 16, functioning as gate electrodes, spans across the insulative barriers 14. Therefore, the gate wires 16 are suspended over the cathode wires 12. Each of the gate wires 16 has two opposite end portions 162 that extend downwardly to the bottom substrate 11. The field emission device 10 further includes a number of gate pads 17 formed on two opposite lateral sides of the bottom substrate 11 and in contact therewith. Each end portion 162 of the gate wire 16 is attached to and electrically connected with one gate pad 17, respectively. Each of the gate pads 17 has a portion extending outside of the inner space defined by the bottom substrate 11, the top plate 21, and the insulative spacers 18. Each such extension portion of the gate pads 17 is structured and arranged for facilitating connection with a second signal transferring device (not shown).

The field emission device 10 further includes an anode layer 22 and a number of phosphor layers 23 formed on and electrically coupled with the anode layer 22. The anode layer functions as an anode electrode and is directly formed on an inner surface of the top plate 21. The phosphor layers 23 have a phosphor material that is capable of emitting light of a corresponding color under bombardment of electrons.

Advantageously, the bottom substrate 11 can be composed of an insulative material, such as glass, silicon, or a ceramic. The top plate can be made of a transparent glass sheet. The anode layer 22 can be made of an indium-tin-oxide (ITO) thin film. The insulative barriers 14 can be made of an insulative material, such as glass, silicon, etc. The cathode wires 12 can advantageously be made of a conductive material having a high conductivity, such as gold, nickel, etc. The cathode wires 12 can be made into a desired size. For example, a diameter of the cathode wires 12 can be about in the range from 10 to 100 micrometers. The electron emitters 13 can be formed on the cathode wires 12 via a suitable method. For example, the electron emitters 13 can be directly grown upon the cathode wires 12 (such as nickel wires) via a chemical vapor deposition process or attached to the surface of the cathode wires 12 by an adhesive. Such electron emitters 13 advantageously radially extend from the respective cathode wires 12.

Advantageously, the cathode wires 12 are cylindrical and have a curved surface. This shape is advantageous because of, first, more electron emitters 13 can be formed on the curved surface; second, the electron emitters 13 can be arranged in a radial configuration, thereby increasing a distance between tips of two neighboring carbon nanotubes and reducing the potential of a field shielding effect therebetween.

The gate wires 16 are spaced a distance apart from the electron emitters 13. That is, a height of the insulative barriers 14 is greater than the diameter of the cathode wires 12 and a length of the electron emitters 13 to avoid a short-circuit between the gate wires 16 and the emitters 13. Preferably, the distance between the gate wires 16 and the emitters 13 is desired to be as short as possible in order to lower/minimize a threshold voltage for emitting electrons.

The gate wires 16 can be made of a conductive material having a high conductivity, such as gold, nickel, etc. Preferably, in order to eliminate blocking electrons emitted from the emitters, a diameter of the gate wires 16 is made as small as possible, provided that a sufficient mechanical strength is satisfied. For example, the diameter of the gate wires 16 can be in the range of about from 1 micrometer to tens of micrometers. The gate wires 16 can be attached to a top surface of the insulative barriers 14 via an adhesive or other suitable means. For example, the gate wires 16 can be attached to and fixed on the insulative barriers 14 via following method: printing a layer of glass paste on the top surface of the insulative barriers 14; attaching the gate wires 16 to the top surface of the insulative barriers 14 temporarily; sintering the glass paste with the gate wires 16; and therefore, effectively soldering the gate wires 16 on the top surface of the insulative barriers 14 via the glass.

In a typical triode type field emission display, the gate electrodes and cathode electrodes are perpendicularly configured into rows and columns respectively. The scanning signal and controlling signal are applied to the cathode electrodes and the gate electrodes, respectively. In the present embodiment, the gate wires 16 (functioning as gate electrodes) and the cathode wires 12 (functioning as cathode electrodes) can be assembled into rows and columns, similar to the above configuration. Each intersectional area of the gate wires 16 and the cathode wires 12 corresponds to a pixel area.

In the present embodiment, each of the phosphor layers 23 corresponds to and faces toward a respective cathode wire 12. Each of the gate wires 16 is perpendicular to and suspended over the cathode wires 12. This combined structure effectively defines a suspended central-gated field emission structure 19.

In use, different voltages can be applied to the anode layer 22, gate wires 16 and the cathode wires 12; for example, 1000 volts to several thousands volts for the anode layer 22, several tens of volts to a hundred volts for the gate wires 16, and a zero or grounded voltage for the cathode wires 12. Electrons are extracted from the emitters 13 by a strong electric field generated by the gate wires 16 and accelerated by an electric field, generated by the anode layer 22, toward the phosphor layers 23. Thereby, visible light of desired color emits from the phosphor layers 23 under bombardment by the electrons.

In the present embodiment, the gate wires 16 not only act to extract electrons from the tips of the emitters 13 but also precisely focus the electrons to the phosphor layers 23. More detailed structures of the field emission device 10, including an electron focusing mechanism and other features, will be described in detail below.

Figure 3:
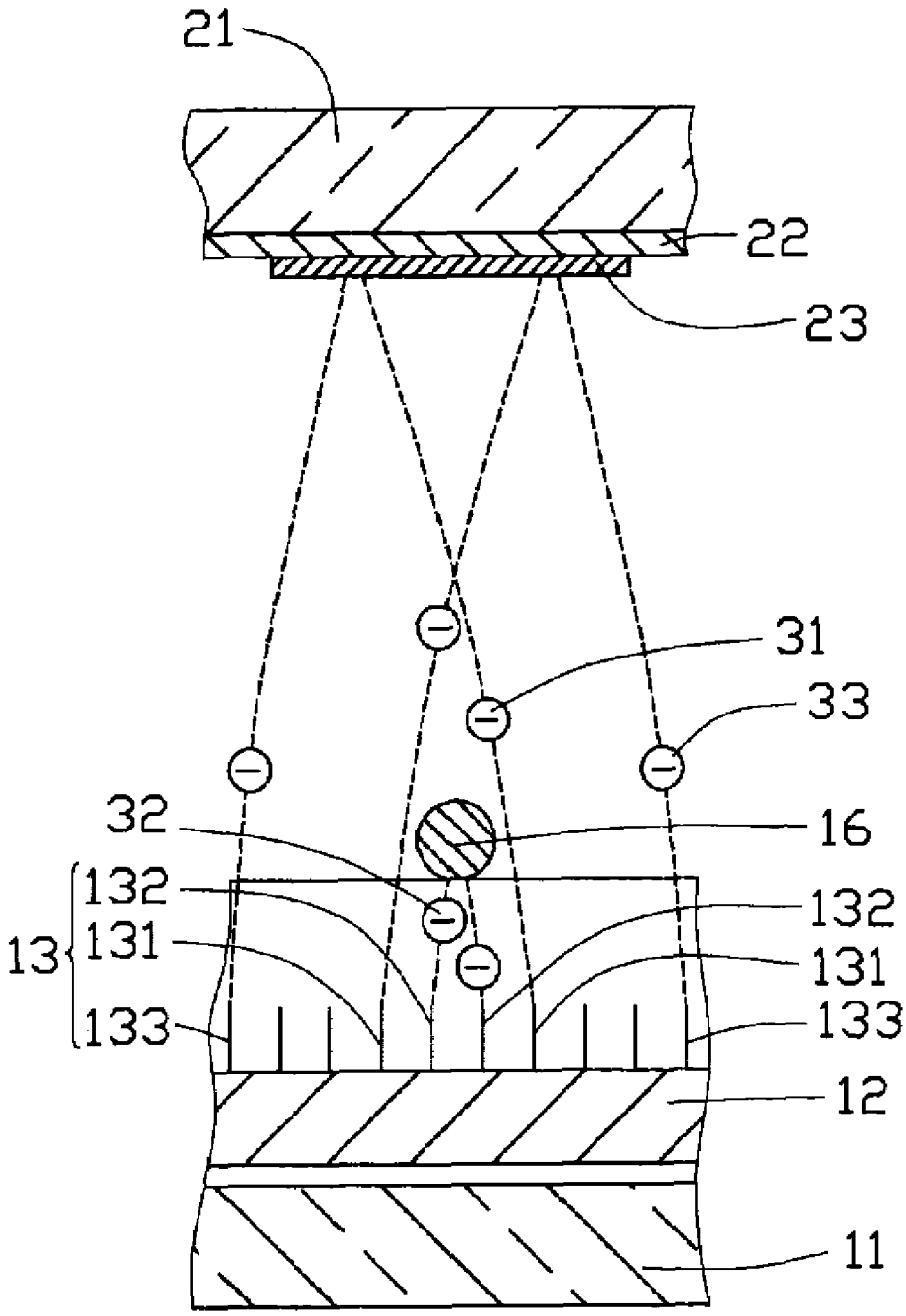
FIG. 3 is an partial cross-sectional view of the field emission device of FIG. 2, showing the movement path of electrons.

Referring to FIG. 3, paths of electrons emitted from the emitters 13 are shown. It is noted that the structure shown in FIG. 3 may be correspond to one picture element, such as a red picture element. It is also noted that there are in fact many emitters 13 distributed upon the cathode wire 12. However, only some of the emitters 13 are shown in FIG. 3 for illustration, and only a portion of the electrons emitted from some of the emitters 13 are illustrated in FIG. 3. Electrons emitted from other emitters 13 near the corresponding gate wire 16 are subjected to the same electric field and move in a similar way.

Generally, the electrons emitted from the emitters 13 can be classified in to three kinds: external electrons 33, internal electrons 31 and obstructed electrons 32. The external electrons 33 are emitted from emitters 133 that are far away from the corresponding gate wire 16 and are subjected to the electrical field generated by the gate wire 16. The external electrons 33 are attracted by the electrical field somewhat towards to the gate wire 16 and reach a vicinity of a central area of the phosphor layer 23. The internal electrons 31 are emitted from emitters 131 that are near the gate wire 16 and are subjected to the electrical field generated by the gate wire 16. The internal electrons 31 are attracted by the electrical field and reach a central area of the phosphor layer 23. The obstructed electrons 32 are emitted from the emitters 132 that are covered by a vertical projection of the gate wire 16. The obstructed electrons 32 are blocked by the gate wire 16 during their travel and cannot travel to the phosphor layer 23.

Corresponding to the three kinds of electrons, the surface of the cathode wire 12 for carrying the emitters 13 can be classified into three portions: a first portion at a first side of the gate wire 16, a second portion at an opposite second side of the gate wire 16, and a central portion exactly beneath the gate wire 16 and covered by a vertical projection of the gate wire 16. The central portion is located between the first and the second portions. The emitters 131 and 133 are respectively formed on the first portion and the second portions of the gate wire 16, and the emitters 132 are formed on the central portion. It is understood that the number of emitters 132 formed on the central portion is less than the number of the emitters 131 and 133 on either of the first and second portions. In addition, the smaller the diameter of the gate wire 16 is, the fewer the number of emitters 132 covered/blocked by the gate wire 16. In other words, most of the emitters 13 can effectively emit electrons for bombardment of the phosphor layer 23, when a narrower gate wire 16 is employed. Therefore, an efficiency of electron emission is improved. In addition, because of the focusing effect of the gate wire 16, a light spot (the area that is bombarded by the emitting electrons) on the phosphor layer 23 is minimized, and a display having a higher resolution and better quality can be realized.

Figure 4:
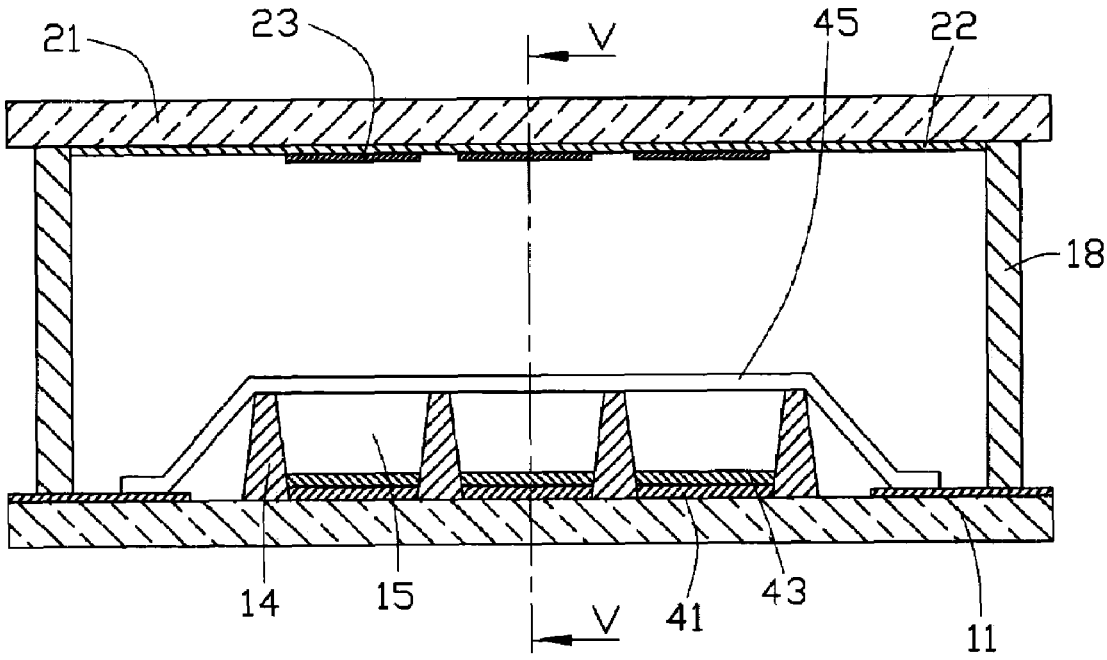
FIG. 4 is a schematic, cross-sectional view of a field emission device, according to a second preferred embodiment.
Figure 5:
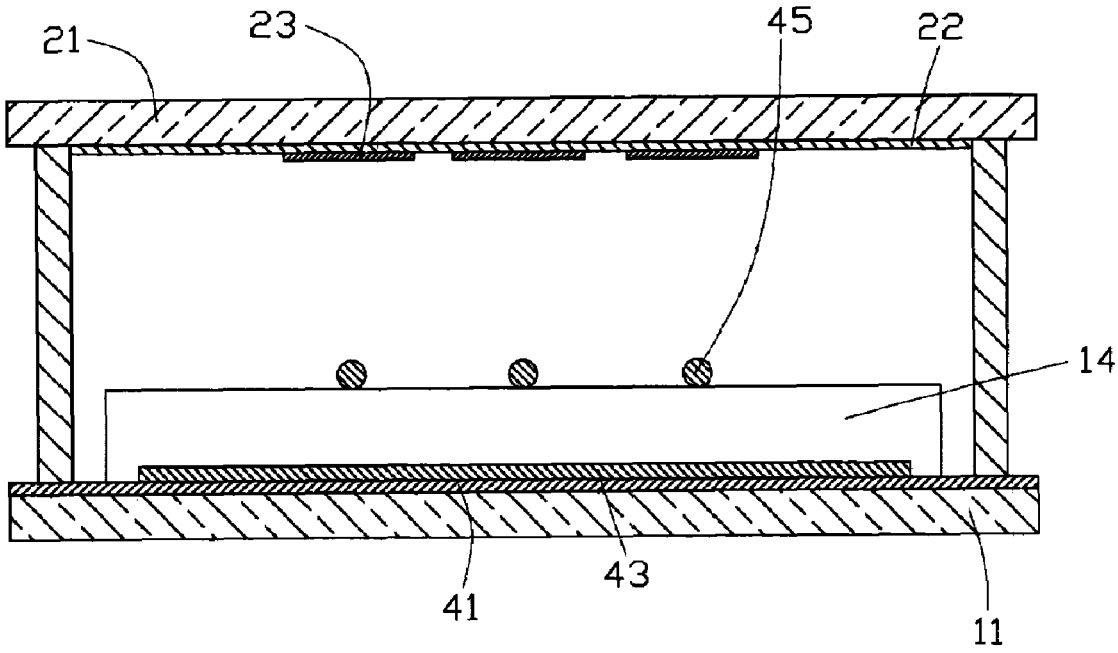
FIG. 5 is a schematic, cross-sectional view taken along line V-V of FIG. 4.
Figure 6:
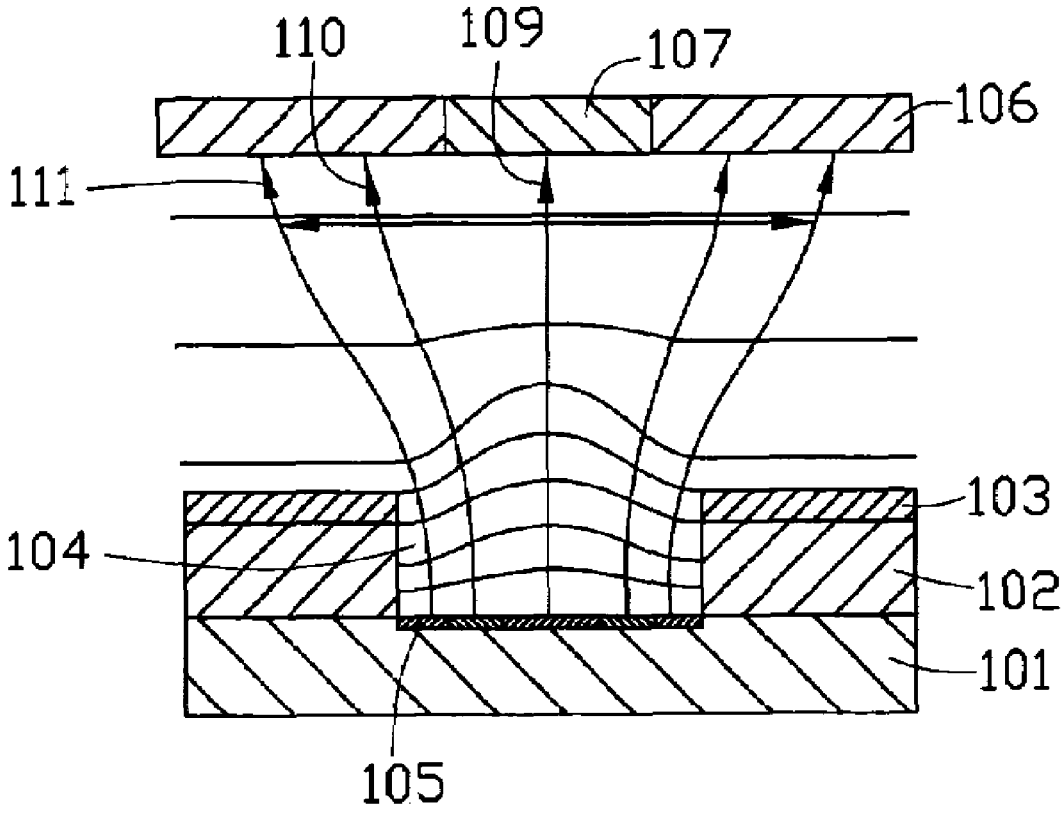
FIG. 6 (PRIOR ART)
FIG. 6 is a schematic, cross-sectional view of a conventional field emission device.
Figure 7:
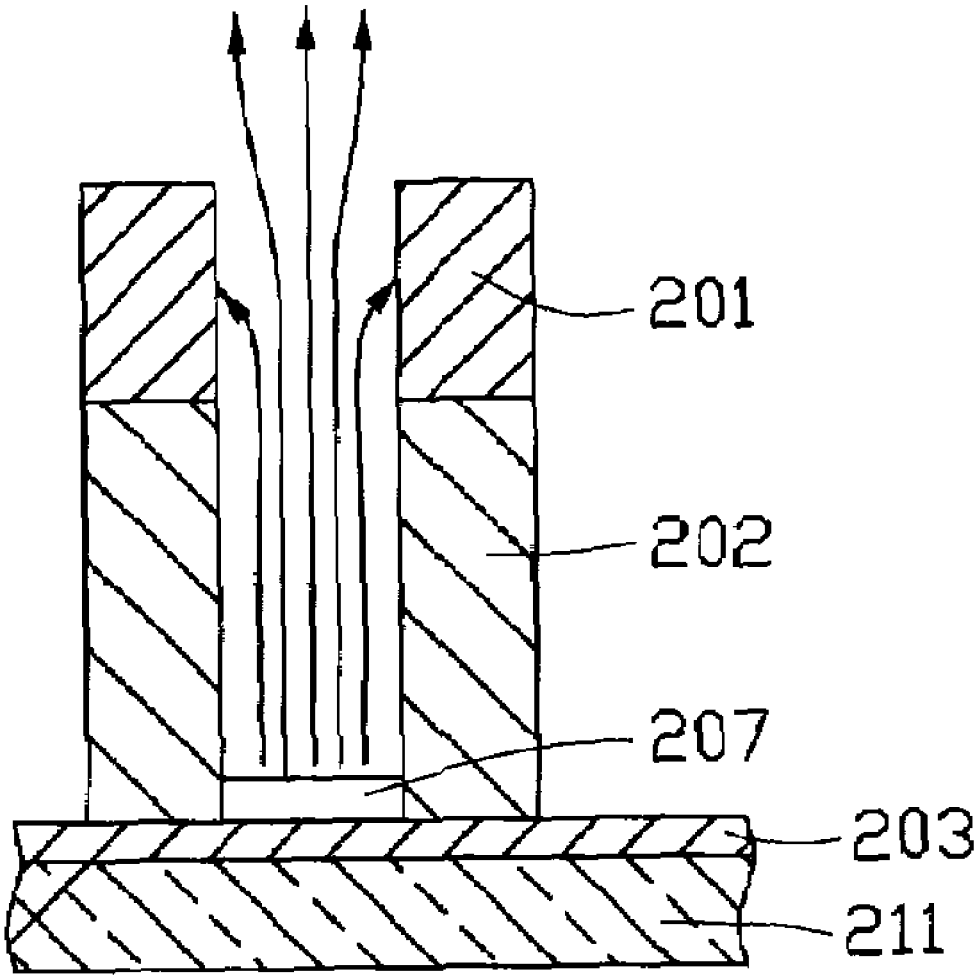
FIG. 7 (PRIOR ART)
FIG. 7 is a schematic, cross-sectional view of another conventional field emission device.

Referring to FIGS. 4 and 5, a field emission device according to a second embodiment is shown. The field emission device of the second embodiment is similar to the first embodiment and includes a bottom substrate 11, a top plate 21 opposite to the bottom substrate 11, a number of insulative barriers 14 formed on the bottom substrate 11, an anode layer 22, and a number of phosphor layers. A number of slots 15 are defined between two neighboring insulative barriers 14, respectively. In addition, a number of cathode layers 41 are formed on the bottom of the slots 15. A number of emitter layers 43 are formed on the cathode layers 41, respectively. The cathode layers 41 are substantially parallel to the insulative barriers 14 and can be made of an electrically conductive thin film, such as a nickel thin film, a copper thin film and/or a gold thin film, or a composite of such films. Furthermore, a number of gate wires 45 spans across the insulative barriers 14 and are advantageously perpendicular to the cathode layers 41. An intersection of the gate wires 45 and the cathode layers 41 respectively corresponds to a phosphor layer 23. The emitter layers 43 can be formed on the surface of the cathode layer 41, e.g., by printing an emitter paste thereon or by another deposition process. It is understood that the emitter layer 43 can be distributed on an entire surface of the cathode layers 41 or distributed on portions of the surface of the cathode layers 41 that intersecting with the gate wires 45.

The movement paths of electrons emitted from the emitter layers 43 of the second embodiment are similar to that of the first embodiment. The gate wires 45 are configured for extracting electrons from the emitter layers and for focusing the electrons onto the corresponding phosphor layers 23. In both embodiments the gate wires are sufficiently narrow and at least a portion of the emitters are located on the cathode in a manner so as not to be directly below a corresponding gate wire. Such an arrangement facilitates control of the emitted electrons by the gate wire while still allowing a high percentage of such electrons to effectively reach the appropriate position on the corresponding phosphor layer.

It is understood that the emitters for emitting electrons include carbon nanotubes and other elements having a portion for emitting electrons, for example, carbon fibers, or an element having a sharp/narrow tip made of graphite carbon, diamond carbon, silicon, and/or a suitably emissive metal.

It is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field emission device, comprising:

an anode electrode having a phosphor layer;

a cathode electrode spaced apart from the anode electrode;

a plurality of electron emitters being successively located on the cathode electrode; and a gate wire electrode positioned between the anode electrode and the electron emitters and corresponding to the substantial center of the phosphor layer;

wherein a part of the gate wire is located within the boundary of the electron emitters, the gate wire electrode extracts electrons from the electron emitters and focuses the electrons to the phosphor layer;

wherein the gate wire is positioned on a direct path between the at least some of the plurality of electron emitters and the anode electrode, and the direct path is parallel to a line substantially perpendicular to the anode electrode.

2. The field emission device as claimed in claim 1, wherein the phosphor layer corresponds to a picture element of a display.

3. The field emission device as claimed in claim 1, wherein the gate wire electrode is positioned perpendicular to and suspended over the cathode electrode.

4. The field emission device as claimed in claim 1, further comprising a bottom substrate and an opposite top plate; the anode electrode being positioned on the top plate so as to face the cathode, the cathode electrode being arranged proximate the bottom substrate.

5. The field emission device as claimed in claim 4, further comprising at least two insulative barriers formed on the bottom substrate, each of the at least two insulative barriers is wedge-shaped, each two neighboring insulative barriers defining a slot therebetween, the cathode electrode being disposed at a bottom of the slot, the gate wire electrode spanning across and being attached to a top portion of the insulative barriers.

6. The field emission device as claimed in claim 5, further comprising two cathode pads disposed on the bottom substrate, the cathode electrode being electrically connected with the two cathode pads.

7. The field emission device as claimed in claim 6, further comprising a plurality of insulative spacers arranged between the bottom substrate and the top plate, and each of the cathode pads has a portion extending outside of an inner space enclosed by the bottom substrate, the top plate and the insulative spacers.

8. The field emission device as claimed in claim 7, the cathode electrode is disposed on the two cathode pads and suspended over the bottom substrate.

9. The field emission device as claimed in claim 7, further comprising two gate pads, the gate wire electrode being electrically connected with the two gate pads, each of the gate pads has a portion extending outside of the inner space enclosed by the bottom substrate, the top plate and the insulative spacers.

10. The field emission device as claimed in claim 1, wherein the gate wire electrode is composed of an electrically conductive wire.

11. The field emission device as claimed in claim 10, wherein the electrically conductive wire is comprised of at least one of nickel and gold.

12. The field emission device as claimed in claim 1, wherein the cathode electrode is comprised of one of a cylindrical conductive wire and a conductive thin film.

13. A field emission device, comprising:

an anode electrode having a plurality of phosphor layers attached thereon;

a plurality of cathode electrodes arranged parallel to each other and facing toward the anode electrode;

a plurality of electron emitters being successively located on a surface of each cathode electrode; and a plurality of gate wires positioned parallel to each other and between the anode electrode and the electron emitters, each of the gate wire corresponding to a center of one of the phosphor layer;

wherein a part of the gate wire is located interior of the boundary of the electron emitters, the gate wire electrode extracts electrons from the electron emitters and focuses the electrons to the phosphor layer;

wherein at least one gate wire is positioned on a direct path between the at least some of the plurality of electron emitters and the anode electrode, and the direct path is parallel to a line substantially perpendicular to the anode electrode.

14. The field emission device as claimed in claim 13, wherein the gate electrodes are positioned perpendicular to and suspended over the cathode electrodes.

15. The field emission device as claimed in claim 13, further comprising a bottom substrate and a top plate opposite to the bottom substrate; the anode electrode being arranged on the top plate and facing the cathode electrodes, the cathode electrodes being proximate the bottom substrate.

16. The field emission device as claimed in claim 15, further comprising a plurality of insulative barriers formed on the bottom substrate, a plurality of slots being defined between respective neighboring pairs of insulative barriers, each cathode electrodes being respectively disposed at a bottom of a corresponding slot, the gate electrodes spanning across and being attached to top portions of the insulative barriers.

17. The field emission device as claimed in claim 16, further comprising a plurality of cathode pads provided on the bottom substrate, each of the cathode electrodes being respectively electrically connected with a corresponding two opposite cathode pads.

18. The field emission device as claimed in claim 13, wherein each gate electrodes comprises an electrically conductive wire.

19. The field emission device as claimed in claim 18, wherein the electrically conductive wire comprises at least one of nickel, copper, and gold.

20. The field emission device as claimed in claim 13, wherein the cathode electrode comprises one of a cylindrical conductive wire and at least one conductive thin film.

21. The field emission device as claimed in claim 13, further comprising a plurality of gate pads, each of the gate electrodes being electrically connected with two opposite gate pads.

22. A field emission device, comprising:

a bottom substrate;

a top plate opposite to the bottom substrate;

an anode electrode attached on the top plate, the anode electrode having a phosphor layer attached thereon, the phosphor layer facing the bottom substrate;

a cathode electrode positioned proximate the bottom substrate, the cathode electrode having a curved surface;

a plurality of electron emitters being successively located on the curved surface of the cathode in a radial configuration; and a gate wire arranged and spaced between the anode electrode and the electron emitters, the gate wire operatively corresponding to a center of the phosphor layer, a part of the gate wire being located interior of the boundary of the electron emitters, the gate wire extracts electrons from the electron emitters and focuses the electrons to the phosphor layer, wherein the gate wire is positioned on a direct path between the at least some of the plurality of electron emitters and the anode electrode, and the direct path is parallel to a line substantially perpendicular to the anode electrode.

23. The field emission device as claimed in claim 22, further comprising a plurality of insulative barriers formed on the bottom substrate, the gate wire being spanning across and attached to respective tops of the insulative barriers.

* * * * *